US005285584A

United States Patent [19]

Dubner

[11] Patent Number: 5,285,584

[45] Date of Patent: Feb. 15, 1994

[54] MECHANICAL CUSTOM MOLDING OF FOOTGEAR

[76] Inventor: Benjamin B. Dubner, 84 Marcus Ave., New Hyde Park, LI, N.Y. 11040

[21] Appl. No.: 713,778

[22] Filed: Jun. 12, 1991

[51] Int. Cl.[5] ..... A43B 13/38; A43B 7/14; A43B 7/22

[52] U.S. Cl. ..... 36/88; 36/91; 36/93; 36/145; 36/150; 36/156; 36/155; 36/166; 36/169; 36/173; 36/174; 36/180

[58] Field of Search ..... 36/88, 91, 93, 92, 71, 36/35 A, 34 R, 145, 149, 150, 151, 155, 156, 157, 166, 169, 173, 174, 175, 176, 180, 182

[56] References Cited

U.S. PATENT DOCUMENTS

| | | | |
|---|---|---|---|
| 1,904,789 | 4/1933 | Howell | 36/156 |
| 1,904,790 | 4/1933 | Howell | 36/156 |
| 2,075,941 | 4/1937 | Howell | 36/161 |
| 2,114,089 | 4/1938 | Trick | 36/156 |
| 2,295,364 | 9/1942 | Skorepa | 36/156 |
| 2,779,110 | 1/1957 | Howell | 36/156 |
| 4,765,070 | 8/1988 | Chemello | 36/91 |
| 5,036,604 | 8/1991 | Rosen | 36/88 |

*Primary Examiner*—Paul T. Sewell
*Assistant Examiner*—M. D. Patterson

[57] ABSTRACT

An apparatus for providing footgear with comfortable individualized custom support, said apparatus comprising mechanical means to selectively and seperately change the position of multiple areas of the inner sole of said footgear, said areas corresponding generally to the areas of the foot described as the inner heel, the lateral arch, and the metatarsal area, and, whereas such changing of positions involves movement in two different directions: (1) upward and downward, (2) forward and backward, said changes in position are achieved by two different and seperate structures, wherein the movement of each of said structures is controlled by the selective turning of a screw, the heads of said screws being located on the outside of said footgear, where they can be selectively turned at any time.

2 Claims, 2 Drawing Sheets

MECHANICAL CUSTOM MOLDING OF FOOTGEAR

BACKGROUND OF THE INVENTION

The invention relates generally to the field of footgear: dress shoes, athletic boots, sneakers, orthopedic shoes, and the like, and more particularly to an improved means for accomplishing quick, easy, inexpensive and therapeutic individual custom adjustments to accommodate the needs of each individual foot by mechanical means within said footgear.

Walking is a complicated bio-mechanical process. In the first stage of walking, at heel strike, the Talus and the attached Calcaneous (heel) bones move inwardly and downwardly, said movement acting as a shock absorber. The range of motion of said movement is called pronation. Said pronation is a direct factor that determines the efficiency of the foot and leg. At this and subsequent stages of walking an abnormal amount of pronation, whether greater or lesser than it should be, results in excessive strain to all the directly and indirectly connected joints, bones, ligaments, nerves and muscles. Said strain thus gives rise to various symptoms such as pain, aching, fatigue, cramping, pulling feelings, weakness, etc. The effected areas are not only the foot and leg, but anywhere throughout the skeletal system. For instance, one common sequelae of abnormal pronation is the so-called "bad back". An excess of pronation results in an excessive spinal curve, which weakens the back so that an additional strain can put the back "out." Then, there are two problems, the original weak position, and the secondary damage that resulted from it. Usually only the acute secondary condition is treated which accounts for the chronicity of such problems.

Abnormal pronation can result from many and varied causes, ranging from tight posterior leg muscles to unusually shaped foot bones. The shape and style of footgear also imposes its own complications to gait. Said footgear is manufactured on lasts contoured to an "average" foot which, by definition, is nonexistent. Within a similar shoe size, each foot has its own shape and dimensions. Said lasts are further distorted by considerations of style and heel height, which have further negative effects on the bio-mechanics of weight bearing activity.

It is known in the art to control postural problems of individual feet by various means worn inside footgear. However, each of said means has its own advantages and disadvantages.

There are the well known "arch supports" which are inexpensively sold over the counter in arbitrary shoe sizes. There are methods of molding the interior of a shoe by placing a bag therein, and introducing a molding material into said bag, which "sets" with the imprint of the foot.

The best means of helping feet, based on scientific principles, are Foot Orthotics. Said Orthotics are shaped to fit the entire plantar surface of a foot from the "ball" of said foot to the heel, with some lateral and medial cupping of the heel area. Said Orthotics are formed over a positive Plaster of Paris cast of an individual foot, said cast derived from a negative cast taken while the foot was held in a neutral position by a Doctor or skilled technician. Laboratories then fabricate the Orthotic. Adjustments may then have to be made to compensate for dynamic problems which a static cast cannot duplicate. Further, a hard cast cannot properly reproduce the difference between a thin skinned and a fat foot, which influences the result. Said Orthotics cannot be worn in all shoes, and especially not in most ladies' dress shoes. The above process takes about two weeks and can cost between $300 to $500.

All of these devices, and others, have common faults. They take up space within the footgear. They fit differently in different shoes. They cannot be easily adjusted. They are expensive and require varying degrees of trained personnel for dispensing and adjustment. Much time is necessary for adjustments.

To retain the benefits of such appliances while eliminating some of the disadvantages, the present inventor has been issued U.S. Pat. No. 4,744,157. Said Patent was based on the fact that a Foot Orthotic has three basic major therapeutic areas which benefit the foot. The other substance of the Orthotic acts mostly to hold the three areas in correct position relative to the foot and shoe. By controlling only the basic areas, no space in the footgear was taken up with useless connective substance.

The three basic areas of a Foot Orthotic are: the inner aspect of the heel, the area under the lateral arch of the foot, and the area directly behind the metatarsal arch of the foot. Said metatarsal arch is the parabola made up of the individual heads of the five Metatarsal bones. Occasionally the inner long arch area is involved.

Of these areas, the inner aspect of the heel, which is where the pronation angulation occurs, is by far the most important area. Seventy to ninety percent of the benefits arising from the use of an Orthotic is due to control imposed on this area. Control of the metatarsal area is next in importance, and then the lateral arch area. All of these areas are affected at different stages of walking. And, it is to be noted that high heeled shoes do not lend themselves to pronation control because of the unsteady nature of said heels. There, metatarsal control becomes a much more important factor.

In the invention cited, varying control of the three important areas was accomplished with the use of multiple individually complete elements. Each of said elements comprising: impervious flexible bags for receiving and maintaining a non-setting fluid, such as water; an end port with a valve-like action to maintain closure while permitting selective insertion and withdrawal of said fluid; and a connective tube between said port and said bag. Hypodermic syringes and needles were used to insert and withdraw fluids through said end ports.

While the above means achieved the desired results, said means also presented many problems. Heat sealing of said bags of proper watertight material was difficult, and often leaked under pressure. Insertion of multiple elements into shoes was complicated and laborious as multiple grooves and bores had to be cut into the soles of shoes, and the elements inserted in parts and then secured. There were also difficulties in the procurement and use of hypodermic syringes, so that customers could not themselves adjust their footgear. All of the above made major difficulties for the manufacturing and marketing of said apparatus in footgear.

It is therefore among the principal assets of the present invention to provide improvements for the adjusting of the interior of footgear to the needs of the individual foot, in which the benefits of the above are substantially retained, while the disadvantages are substantially eliminated. Another object of the invention lies in the provision of mechanical means to achieve the desired changes within said footgear. Another object of the invention lies in the provision of means that would allow the customer to achieve necessary changes within seconds, and without the necessity of any specialized training. Another object of the invention lies in the provision of simplified means that can easily be added to already manufactured footgear, as well as reducing the overall cost of such a product.

SUMMARY OF THE INVENTION

In accordance with the objects of maintaining the benefits of Foot Appliances and Foot Orthotics known in the art, while avoiding the problems associated with said Appliances and Orthotics, the present invention is directed to the separate basic therapeutic areas of the inner sole of footgear, said areas being individually controlled and adjusted by mechanical means. Said basic areas of the sole are the inner aspect of the heel, the medial and lateral arch areas, and the metatarsal area.

Adjustment of the pronation angle of the heel requires selective raising or lowering of the medial (inner) aspect of the heel area. Adjustment of the lateral and medial arch areas also requires a raising and lowering of said areas.

If the metatarsal parabola of a wearer fits into the "average" position that is manufactured into the footgear, said parabola will be comfortable supported. If the parabola is forward of said position there will be foot strain caused by nonsupport. A resilient padding, called a metatarsal pad, placed just behind said parabola can give the necessary support. Thus, the controlling action to place said metatarsal pad in optimum position requires selective forward and backward movement of said pad. Also required is a means to vary the thickness of said metatarsal pad to accommodate the various individual heights of said metatarsal arch.

To accommodate the two different movements required, the apparatus of the invention has two separate and different structures herewith designated as structure A and structure B.

Structure A achieves said up and down movement by means of a vertical elevating screw penetrating through the sole of the footgear. Rotation of said elevating screw causes it to rise above said sole within said footgear to contact the bottom of a semi-rigid piece disposed above said inner sole. Continued turning of said elevating screw causes said semi-rigid piece to rise. Thus, a structure A located in the medial area of the heel will cause a rising and tilting of that area. Similarly, a structure A in the lateral arch area will cause a semi-rigid piece in that area to rise. Similarly in the medial arch area.

Upward pressure on said elevating screw releases it from a locking means, permitting rotation of said elevating screw clockwise or counter clockwise to raise or lower said screw. Release of said upward pressure locks said screw into position.

Structure B achieves forward and backward motion of a resilient metatarsal pad within said footgear by means that include a metatarsal mechanism. Said metatarsal mechanism includes: a metatarsal pad, or the like, attached to two semi-rigid extensions extending in the direction of the heel; spur gear means to impart motions to said metatarsal mechanism; and means to lock said metatarsal mechanism in position. Said extensions have cut out areas within which are gear teeth to engage said uniquely shaped spur gear. Said spur gear penetrates said cut out area of extensions in a general right angle configuration to mesh with gear teeth within said cut out area. Rotation of said spur gear imparts forward or backward motion to said metatarsal mechanism. Lower part of said spur gear is a smooth shaft centered within a retaining screw, which said retaining screw is securely set within a through vertical bore of the sole of said footgear. Upper part of said retaining screw is shaped to receive and mesh with the gear teeth of said spur gear. Said meshing of said spur gear within the immobile retaining screw locks the entire structure B in place.

Upward pressure on the bottom of said spur gear shaft pushes said spur gear out of the upper part of said retaining screw and thus releases said spur gear, permitting rotation clockwise or counter clockwise, to move metatarsal mechanism forward or backward. Release of upward pressure on said spur gear allows a spring means to push said spur gear down to mesh with upper part of said restraining screw to lock all parts of structure B in place.

Said extensions are generally similar and are spaced one above the other. The upper extension piece connects to the rear aspect of said metatarsal pad. The lower extension piece extends under said metatarsal pad and connects to the front aspect of said metatarsal pad. Pushing said spur gear upward raises it out of the locking means of the restraining screw. Continued upward pressure raises spur gear above the gear means of the lower extension. A spring means between upper and lower extensions enhances separation of the two extensions to facilitate the unmeshing of the lower extension.

Rotation of spur gear meshed only with the upper extension will exert a forward motion to the entire metatarsal mechanism. When the anterior aspect of said metatarsal pad of said metatarsal mechanism reaches the "ball" of the foot, forward motion of said metatarsal pad is stopped. Continued forward pressure will then cause a buckling up of said metatarsal pad into a higher configuration governed by the shape of the foot above it. When upward pressure on the spur gear is released, said spur gear is pushed downwards by a spring means above it. Said spur gear now engages both the lower and upper extension pieces, as well as the locking means of said retaining screw and thus locks the metatarsal pad into its new configuration and new position.

When said apparatus is installed into footgear, it is simple to operate this invention. With the wearer's foot within the footgear in a non-weight-bearing position, the screws controlling the various structures are turned until wearer feels the resulting pressure on the foot. Then the wearer walks or runs to test. If the pressure is felt to be excessive, or seems not adequate, said pressure can be decreased of increased.

Not all of the structures of the apparatus need to used in all footgear. The type of footgear may determine which entity is feasible and practical. For example, a high heeled shoe may not be suitable for the pronation control at the heel.

These objects and advantages will more fully appear in the progress of the following disclosure, and be pointed out in appended claims. In the drawings to which reference will be made in the specification, similar characters have been employed to designate corresponding parts throughout the several views.

FIG. 1. Schematic longitudinal section of a shoe illustrating cut out areas of sole and heel to contain the invention, and two inner sole pieces.

FIG. 2. Schematic longitudinal section showing details of structure A.

FIG. 3. Schematic longitudinal section showing details of structure B in locked position.

FIG. 4. Schematic longitudinal section showing details of structure B in unlocked position.

FIG. 5. Plan view of spur gear and upper part of restraining screw at line 1—1 of FIG. 3.

FIG. 6. Plan view of metatarsal pad and extensions.

FIG. 7. Longitudinal section of metatarsal and extensions in unstressed position.

FIG. 8. Longitudinal section of metatarsal and extensions in stressed position.

FIG. 9. Cross section of sole at line 2—2 of FIG. 1 illustrating cut out areas of sole to contain structure B and overriding spring.

FIG. 10. Cross cut view of heel seat piece of inner sole at line 3—3 of FIG. 1.

DESCRIPTION OF PREFERRED EMBODIMENT

The apparatus of the invention comprises two different kinds of structure, illustrated as structure A (FIG. 2) and structure B (FIGS. 3, 4, 6, 7 and 8), to achieve selective movement in different directions, with semi-permanent relocation of pertinent individual parts of a footgear's insole. Structure A achieves upward and downward motion. Structure B achieves forward and backward motion.

Figure 1:
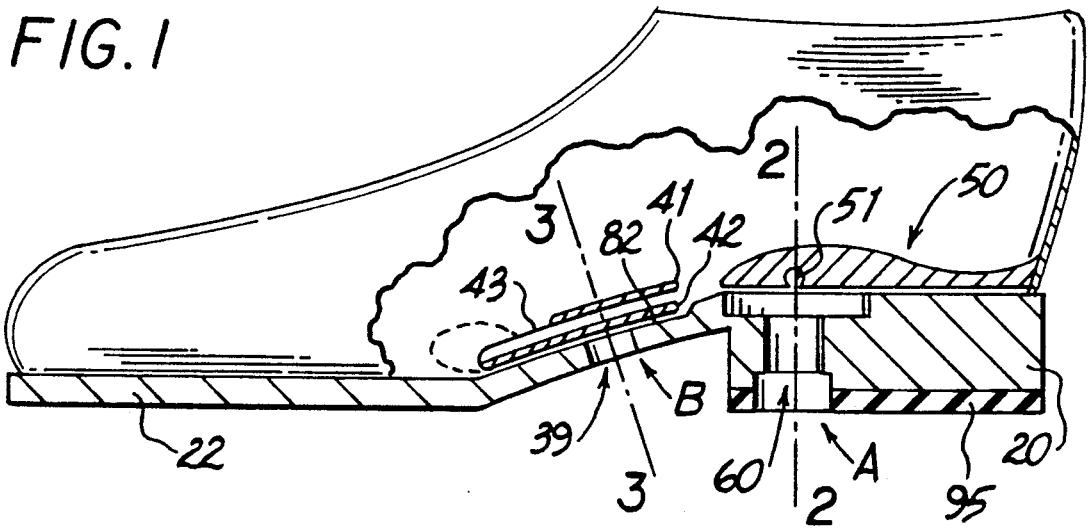

FIG. 1, a longitudinal schematic view of a shoe, illustrates a unique vertical through bore 60 of the inner heel area for the insertion of a structure A, and a through bore 39 in the arch area of said shoe for the insertion of the controlling parts of a structure B. The same general structures can be used in other areas of footgear to achieve similar desired movements.

Figure 2:
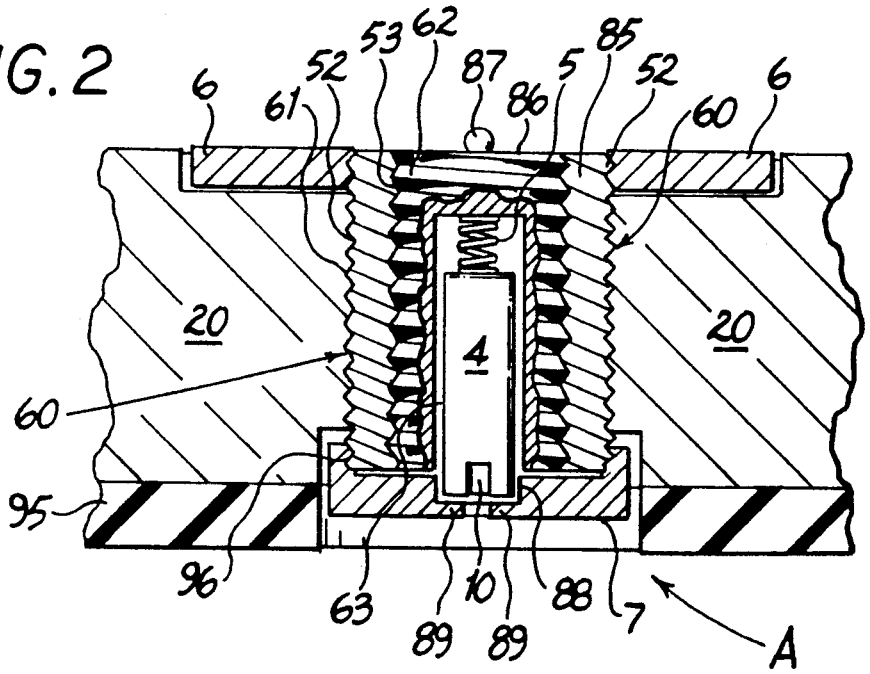
Figure 10:
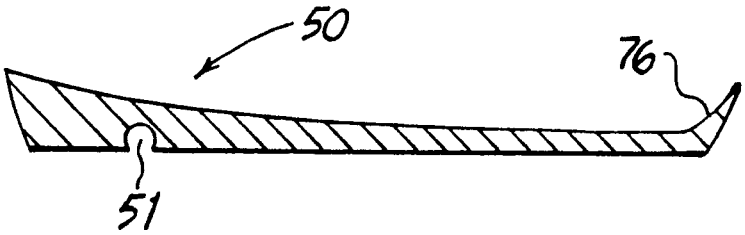

FIG. 2 illustrates a structure A wherein the retaining screw 85 is secured within said through bore 60 of heel area 20. Said retaining screw 85 has outer threads 52 and inner threads 53. Outer threads 52 secure said retaining screw 85 within said through bore 60 by engaging the inner walls 61 of said bore 60. Said inner threads 53 engage and mesh with outer threads 62 of the elevating screw 86. Said screw 86 has a top part 87 shaped to mate with opening 51 of the semi-rigid heel seat 50 (FIGS. 1, 10). Said elevating screw 86 has a centered partial bore 63, shaped in a non-round manner, in this instance square shaped. Said bore 63 contains a freely movable square pin 4 and a spring 5, interspersed between said pin 4 and closed end of partial bore 63. Said spring 5 exerts an outward pressure on said pin 4. Bottom end of pin 4 has a groove 10 (FIG. 2) to selectively mate with a screwdriver blade or the like (not shown).

Nut 6 at the top end and nut 7 at the bottom end engage said outer threads 52 and thus overlap parts of heel 20 to further secure retaining screw 85 within said bore 60. The bottom end of retaining screw 85 and said nut 7 are within a recessed area of said heel 20 so as not to interfere with any shock absorbing outer heel material, such as a rubber heel 95. Upper nut 6 has a broad rim to distribute the loading of downward pressure caused by weight bearing at each step onto said heel 20. The upper part of the inner bore of nut 7 is threaded 96 to engage retaining screw 85. The middle part of nut 7 extends into the center bore of nut 7 in a square shape 88 to receive and mesh with said square shape of pin 4. Said meshing prevents rotation of said pin 4 and said elevating screw 86 with which said pin 4 has a spline relationship. The lower aspect of nut 7 has a lip 89 extending slightly further into said bore of nut 7 to prevent passage of pin 4 through said bore of nut 7.

Enough of an opening remains to permit insertion of a screwdriver blade or the like to selectively engage the groove 10 of pin 4. Upward pressure on pin 4 pushes said pin 4 out of the square shaped 88 portion of nut 7 to permit rotation of said pin 4. Release of said upward pressure causes pin 4 to be pushed downward by spring 5 into said square opening 88, which position prevents rotation of said pin 4 and said screw 86. The periphery of the bottom area of through bore 60 is generally shaped to mate with the outer periphery of nut 7 to prevent rotation of said nut 7 (not shown).

Other areas of the sole that require similar up and down alterations, such as the lateral arch, can be constructed generally as described above.

Figure 5:
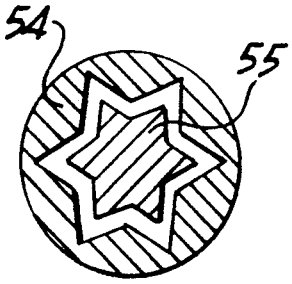
Figure 3:
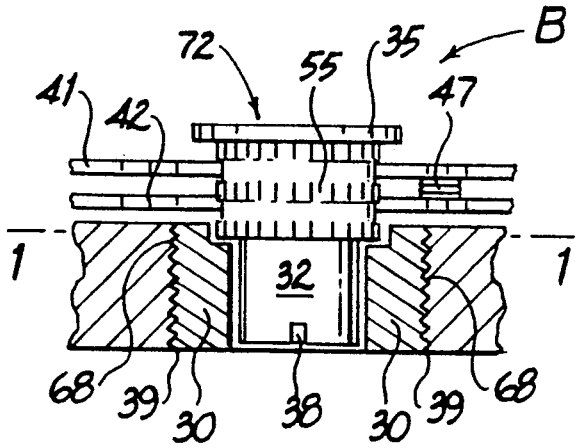
Figure 4:
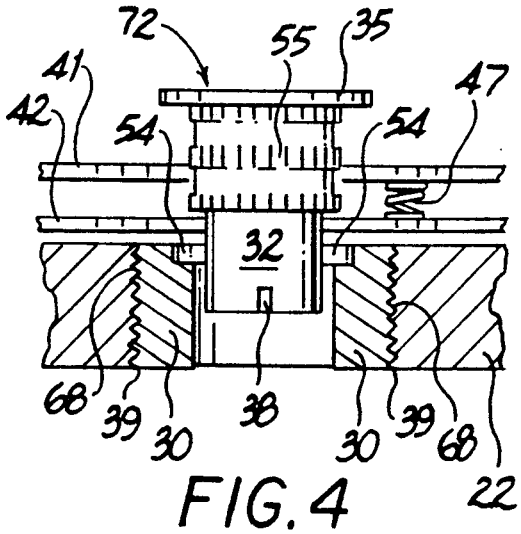

Structure B is comprised of various parts as detailed in FIGS. 3 and 4. A through bore 39 (FIGS. 1, 3 and 4) located generally within the inner aspect of the central arch area of said sole 22 at line 2—2 of FIG. 1 contains a retaining screw 30 with outer threads 68 engaging the inner aspects of through bore 39 to secure said retaining screw 30 within said sole 22. The upper aspect of retaining screw 30 is female shaped 54 (FIGS. 4 and 5) to receive and mate with the lower aspect of the male shaped gear 55 (FIG. 5) of spur gear 72, at line 1—1 of FIG. 3. Said spur gear 72 has a top flange 35 (FIGS. 3 and 4) under which are vertical gear teeth 55 (indicated by dotted lines). Under said gear teeth 55 is a non-toothed shaft 32. Lower aspect of said shaft 32 contains groove 38 to selectively receive a screwdriver blade or the like.

Figure 6:
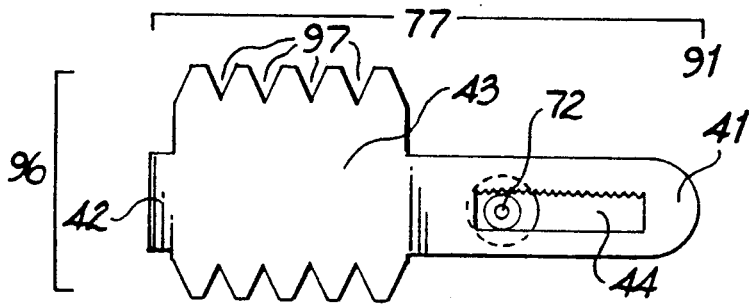
Figure 7:
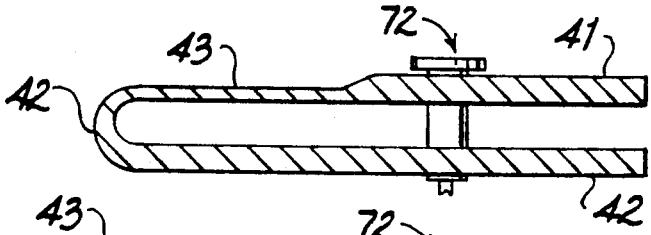
Figure 8:
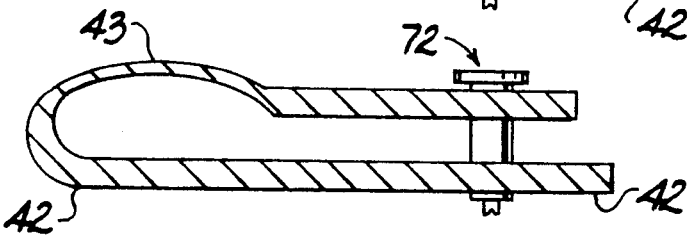

FIG. 6 is a plan view of the metatarsal mechanism 77 of structure B. Said metatarsal mechanism 77 comprises a metatarsal pad part 43 situated between an attached backward element 41 and a forward element 42. The customary metatarsal pad known in the art is usually a shaped resilient rubber-like padding. While such a pad connected to semi-rigid front and back extensions 41 and 42 can be used for the purpose of this invention, the joining of such unlike materials presents certain difficulties in the form of adhesive and material failure and labor intensivity. In keeping with a stated purpose of this invention, these difficulties can be avoided by fabricating the entire metatarsal mechanism 77 in one piece in which the varying degrees of semi-rigidity that are required can be achieved by varying the thickness and shape of said fabrication, as illustrated by metatarsal pad area 43 and extension 41 (FIGS. 6, 7 and 8). The active metatarsal pad area 43 is generally as wide as the cross section of the second and third metatarsal heads 96. The areas 97 extending along both sides of said metatarsal pad 43 are notched to allow for deflection under pressure of the foot and thus not present a single line of pressure that might be uncomfortable to said foot.

The extension 41 from the back of said metatarsal pad 43 is thicker than the metatarsal area 43 (FIGS. 7 and 8) to achieve a greater degree of rigidity than said metatarsal area 43. Said back extension 41 has a generally central cut out area 44, one side of which is notched 91 to receive and mesh with the generally vertical gear teeth 55 of the unique spur gear 72 that penetrates said cut out area 44.

The extension 42, while similar to extension 41 in the degree of rigidity and shape of cut out areas, is longer so that when folded to pass under said metatarsal pad 43, extension 42 will be generally disposed under said backward extension 41 with cut out areas 44 and gear teeth 91 in general alignment with said backward extension 41 (FIGS. 6 and 7).

The unique spur gear 72 which penetrates said extensions 41 and 42 is partially shown in FIGS. 6, 7 and 8. FIG. 7 shows part of spur gear in position to mesh with extensions 41 and 42 in unstressed positions. FIG. 8 illustrates stressed position of metatarsal mechanism as further illustrated in FIG. 3, which shows said spur gear 72 also meshed with the upper part of said restraining screw 54. The lower part 32 of spur gear 72 has no gear teeth and extends into restraining screw 30 (FIGS. 3 and 4). Said lower part 32 has a groove 38 which can selectively mate with a screwdriver blade or the like for the operation of structure B.

To operate structure B a screwdriver blade is inserted into groove 38 with an upward pressure which forces spur gear 72 up and out of the upper shaped aspect 54 of said restraining screw 30, thus freeing said spur gear so that it can be rotated by said screwdriver blade (FIG. 4). Said upward pressure releases pressure on both extensions 41 and 42, allowing spring 47 (FIG. 4) to separate extensions 41 and 42 to expedite the next step. A rigid piece 36 (FIG. 9) limits the amount of upward movement to keep the various parts in a general relative position. In said separated position (FIG. 4) spur gear 72 now only engages the upper extension 41. Turning of said spur gear 72 will then cause forward motion of the entire metatarsal mechanism 77.

When forward motion is stopped when the metatarsal pad 43 reaches the ball of the foot in said shoe (not shown) continued pressure forward will cause a buckling upwards of the more flexible metatarsal pad 43 (FIG. 8). Release of upward pressure on said spur gear 72 will then allow spring 98 (FIG. 9) to push down spur gear 72 so said spur gear 72 will reengage with the lower extension 42 and also remesh with the upper aspect 54 of restraining screw 30, thus locking in place the new configuration and position of said metatarsal pad 43, as illustrated by FIG. 8. A screw or staple means 39 secure spring 98 and rigid piece 36 in place.

Figure 9:
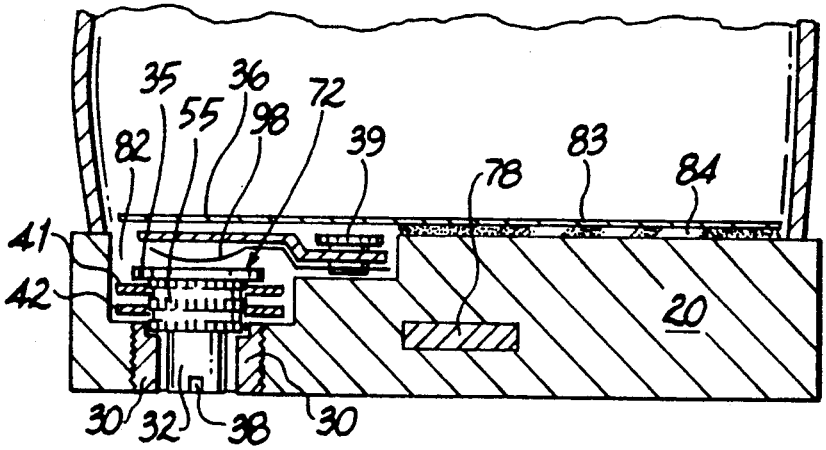

FIG. 9 is a cross cut view of the central area of the shank of the sole of said shoe, illustrating the shaped cut out area 82. Nearby in that area of sole 22 is a rigid supporting element 78 found in the arch areas of most shoes, running from the heel area to the forefoot area. Said cut out area 82 is deep enough to contain said metatarsal mechanism 77 and spring 98 and piece 36. The sock lining 83 is only partially glued 84 to inner sole 20 so as not to interfere with movement of any parts of structure A or B.

It should be noted that structure B is in the medial central area of the shoe located under the long inner arch of the foot, so that there is usually sufficient room for the placement of said structure B.

FIG. 10 is a cross cut of the heel seat piece 50 at line 3—3 of FIG. 1. The varying thickness of said heel seat 50 imposes various degrees of rigidity to said heel seat 50. Outer flange 76 acts to prevent lateral sliding of the foot when inner aspect is raised by the interconnection with elevating screw 86.

The action of the apparatus is controlled entirely by pressure on and turn of the controlling screws 72 and 86. To operate the apparatus with the foot in the footgear in a non-weight-bearing position, each screw is turned until the wearer is conscious of the pressure of the individual inner sole pieces. Then the wearer stands and walks or runs to try the amount of pressure. If too much pressure is felt a turn of the screw will reduce it. If not enough pressure is felt, a turn of the screw in the other direction will correct that. Such adjustments can be made at any time to improve adjustment or to compensate for wearing down of sole, etc.

With the foregoing and other objects in view, the invention resides in the novel arrangement and combination of parts and in the details of construction hereinafter described and claimed, it being understood that changes in the precise embodiment of the invention herein disclosed may be within the scope of what is claimed without departing from the spirit of the invention.

Having thus described my invention, what I claim is new and desire to secure by United States Letters Patent is:

1. Footwear having an inner sole structure adapted to conform to the arch shape of the foot of the wearer first and second mechanical support means selectively positioned beneath the inner sole in proximity to a respective one of the arches of the foot, said first mechanical support means being fixedly adjustable in an up and down direction to cause said inner sole to engage the foot in the area of its associated arch, said second mechanical support means being fixedly adjustable in the forward and backward direction to cause said inner sole to engage the foot in area of associated arch wherein said first means to move separate areas of the inner sole in a selectively up and down direction include a semi rigid part disposed over an elevating screw disposed within a retaining screw that is secured, at least at its upper and lower ends, within a through bore of the sole of the footgear, and where said elevating screw has a partial bore with a pin disposed therein in a spline relationship, a compression spring interspersed between the closed end of the partial bore and said pin, and where the lower securing means of said retaining screw has a bore generally similar in shape of said pin, said bore being lipped to prevent through penetration of said pin, said lipping having sufficient open bore to selectively admit a bladed piece that fits a cut out area in the bottom of said pin to push and rotate said pin.

2. Footwear having an inner sole structure adapted to conform to the arch shape of the foot of the wearer first and second mechanical support means selectively positioned beneath the inner sole in proximity to a respective one of the arches of the foot, said first mechanical support means being fixedly adjustable in an up and down direction to cause said inner sole to engage the foot in the area of its associated arch, said second mechanical support means being fixedly adjustable in the forward and backward direction to cause said inner sole to engage the foot in area of associated arch wherein means to selectively move a part of the sole forward and backward is a metatarsal mechanism which includes a resilient metatarsal pad movably connected to two generally similar semi rigid extension pieces extending back in the direction of the heel and being disposed generally one above the other, where the upper extension piece is movably attached to the back aspect of said metatarsal pad and where the lower extension piece, longer to extend under said metatarsal pad, is movably connected to the front aspect of said metatarsal pad, and where both extension pieces have teeth to engage and mesh with a vertically disposed spur gear having an upper flange overriding generally vertical teeth which override a smooth shaft slidably positioned within a hollow retaining piece located and secured within a through vertical bore of said sole, said retaining piece having an upper aspect shaped to mesh with the lower part of said vertical gear teeth, and where the lower part of said smooth shaft has a cut out area to selectively connect with a shaped piece to push and turn said spur gear, and where said spur gear contacts at its upper aspect means to limit up movement, and means to exert a downward pressure on said spur gear.

* * * * *